US010352035B1

(12) United States Patent
Boor

(10) Patent No.: US 10,352,035 B1
(45) Date of Patent: Jul. 16, 2019

(54) SYSTEM FOR IMPROVED WOOD FRAMING

(71) Applicant: Paul Anthony Boor, Hutchinson, MN (US)

(72) Inventor: Paul Anthony Boor, Hutchinson, MN (US)

( * ) Notice: Subject to any disclaimer, the term of this patent is extended or adjusted under 35 U.S.C. 154(b) by 174 days.

(21) Appl. No.: 14/830,724

(22) Filed: Aug. 19, 2015

Related U.S. Application Data

(60) Provisional application No. 62/070,330, filed on Aug. 22, 2014.

(51) Int. Cl.
*E04B 1/41* (2006.01)
*E04B 1/38* (2006.01)

(52) U.S. Cl.
CPC ..... *E04B 1/40* (2013.01); *E04B 2001/405* (2013.01)

(58) Field of Classification Search
CPC ..... E04C 5/165; Y10T 403/5733; E04B 1/40; E04B 2001/405; E04B 1/26; E04B 1/2604; E04B 1/2608; E04B 1/2612; E04B 2001/2644; E04B 2001/2692
USPC ..... 52/702, 704, 712, 714, 715; 403/401, 403/402, DIG. 15
See application file for complete search history.

(56) References Cited

U.S. PATENT DOCUMENTS 3,256,030 A * 6/1966 Banse ..... E04B 1/2608 248/300
3,258,282 A * 6/1966 Koenigshof ..... E04B 1/2608 403/306
7,788,873 B2 * 9/2010 Leek ..... E04B 1/2608 52/702
2004/0163355 A1 * 8/2004 Collie ..... E04B 7/063 52/702
2005/0155315 A1 * 7/2005 Davis ..... E04B 7/045 52/712
2005/0163564 A1 * 7/2005 Tuell ..... E04B 1/5831 403/403
2006/0193687 A1 * 8/2006 Ghosh ..... E04B 1/26 403/401
2013/0067851 A1 * 3/2013 Zimmerman ..... E04B 7/045 52/707

* cited by examiner

*Primary Examiner* — William V Gilbert

(57) ABSTRACT

Two connectors are used to improve a system of wood framing commonly used to form roof and floor assemblies. The first, the end-to-end connector, allows end-to- end connection of secondary members. The joint thus formed acts as a structural hinge which, when properly located, significantly reduces maximum moment and deflection compared to current simple-span conditions. The second, the top mount connector, provides a secure connection between continuous secondary members and the tops of primary members. This connector provides support for the secondary members and, by resisting rotation between the primary and secondary members, provides superior bracing of the primary member. Used together, the connectors provide an new way of supporting members in a structure, that both reduces maximum moment and deflection and resists rotation between the primary members and the secondary members.

5 Claims, 9 Drawing Sheets

FIG. 8
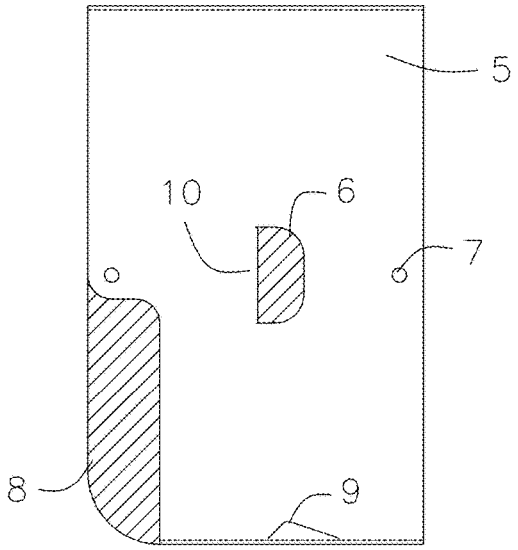
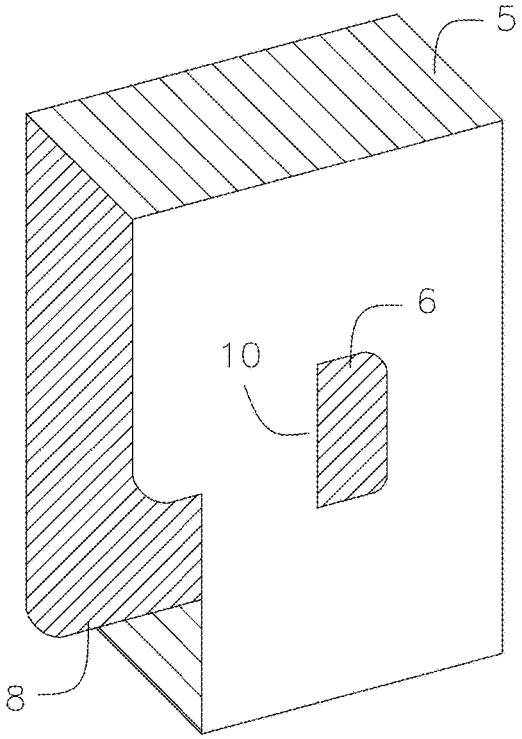
FIG. 9

FIG. 13
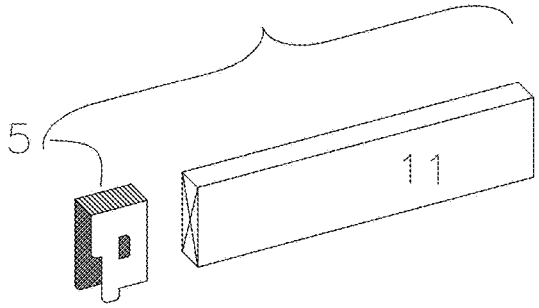
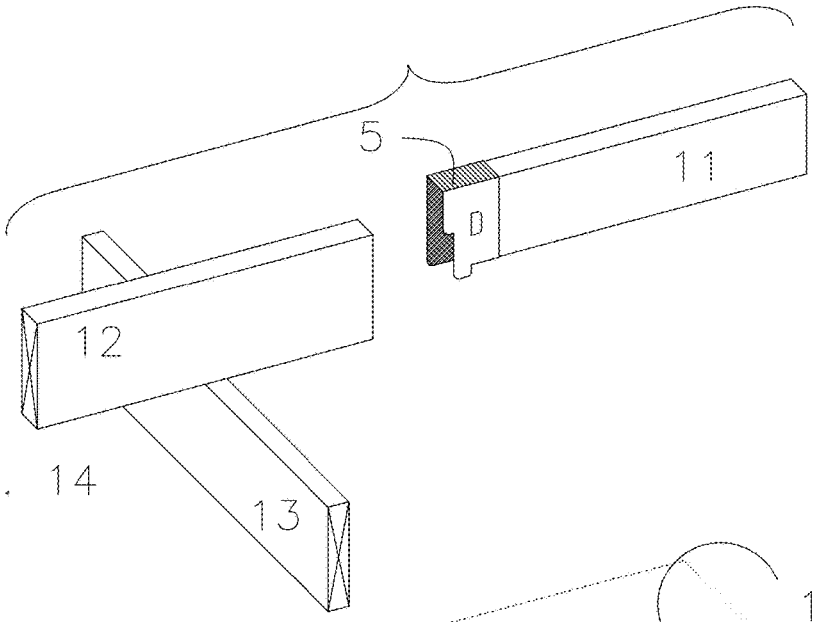
FIG. 14
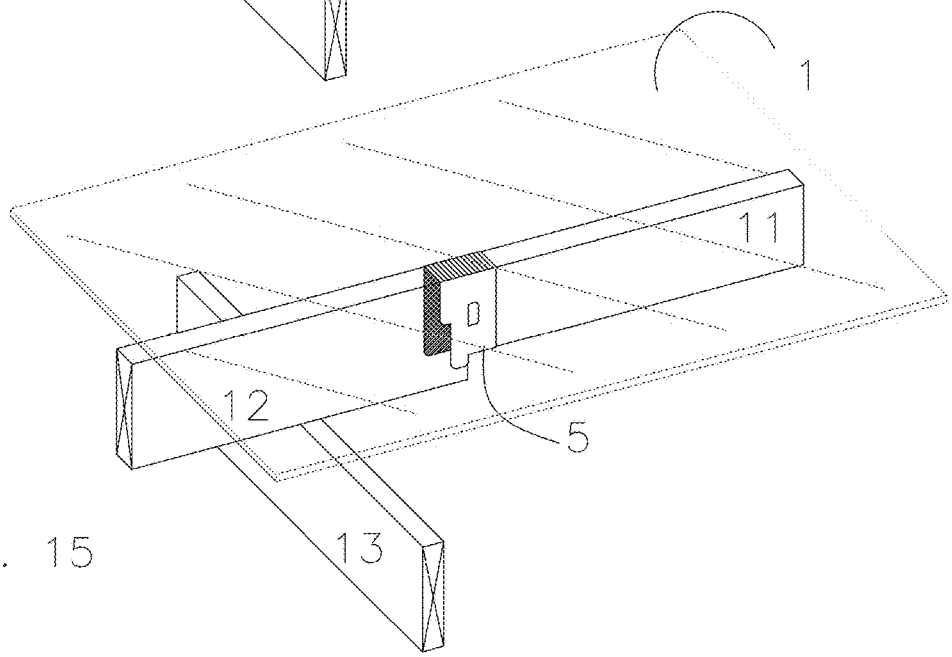
FIG. 15

FIG. 16
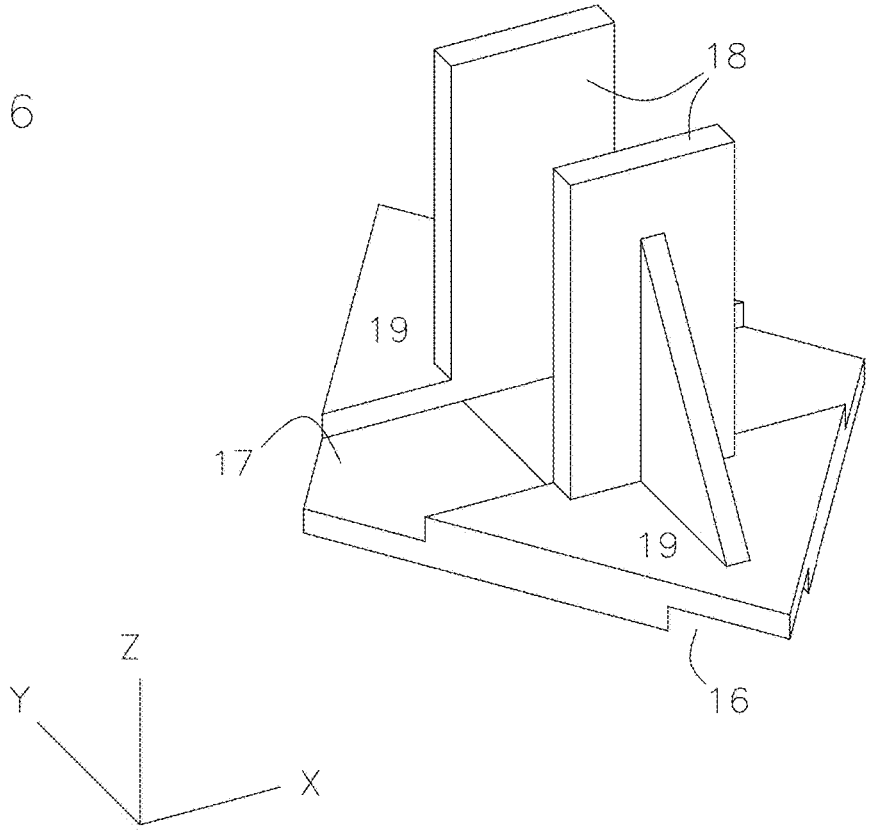
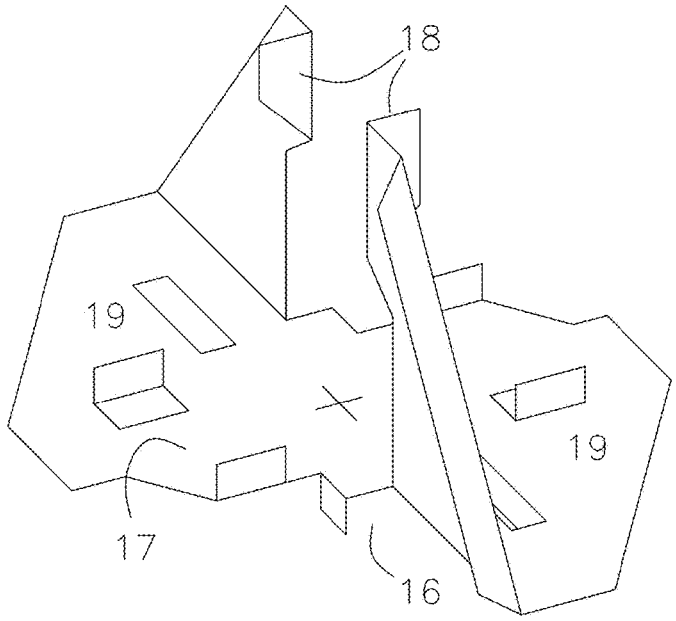
FIG. 17

SYSTEM FOR IMPROVED WOOD FRAMING

BACKGROUND OF THE INVENTION

It is common in the wood construction industry to build roof and floor assemblies by applying continuous sheathing (1) such as plywood or corrugated steel panels to relatively small, closely-spaced repetitive secondary framing members (2). Secondary members are typically solid sawn 2"×4" to 2"x12" lumber spaced 12" to 48" O.C. The secondary members are then supported by larger, more widely spaced primary framing members (3). A wide variety of framing materials and frame spacings are used in primary framing members. Typically the primary members occur multiple times at more or less regular intervals. The secondary members are typically spliced (one member stops and another similar member takes its place and continues on) at each primary member. Alternately the secondary members may be spliced at every second or third primary member. FIG. 1 shows a typical roof plan with primary (3) and secondary (2) framing members. The primary and secondary members can occur repetitively along the length of the building.

The secondary members in the above system serve two functions. First, the secondary members support the sheathing (such as floors or roofs) and associated distributed loads. Second, the secondary members brace the primary members, increasing the load carrying capacity of the primary members by restraining out-of-plane buckling.

The secondary members in the above system are beams because the supported loads are applied perpendicular to the long axis of the members. Beams develop internal forces called shear and moment when loaded. Shear varies linearly over the length of a uniformly loaded beam. The moment is always zero at the free end of beams and varies parabolically over the length of uniformly loaded beams. A simple-span beam has a free end located at each support. FIG. 2 shows a uniformly loaded simple-span beam and the associated shear and moment distribution. FIG. 3 shows a double-span beam, a similar beam that is continuous over two spans. This continuity creates a negative moment region at the interior support 'pulling' the entire moment distribution downward as shown.

The largest moment (negative or positive) frequently controls the size of beam members required to support a structure. Techniques that reduce maximum absolute moment can allow the use of smaller, lower-cost members in place of larger, more expensive members that do not incorporate such techniques. Deflection is also a concern in sizing beams. Techniques that reduce deflection can also allow the use of smaller, less costly members in place of larger, more expensive members. The double-span beam reduces positive moment and drastically reduces deflection when compared to the similar simple-span beam. Also, the double-span beam has zero moment at four locations; once at each end and once at each side of the interior support.

A point of zero moment along the length of a beam is called a structural hinge. Structural hinges can occur as a result of a particular loading and support configuration such as in the two-span uniformly loaded beam shown. Or, an actual physical hinge can be placed in the beam to create a point with no moment capacity. A structural hinge connects the ends of two beams such that they must move together vertically but the ends are free to rotate independently. FIG. 4 shows the moment distribution with a structural hinge located as shown. The largest moment in FIG. 4 is only 0.66 of the simple-span moment. The maximum deflection is about half of the simple-span deflection.

Providing moment continuity across interior supports while including strategically located structural hinges may reduce both maximum absolute moment and maximum deflection thereby allowing the use of smaller, less expensive secondary members.

Primary framing members are frequently in compression as well as bending. Compression members can buckle out of plane at loads far below the member's actual strength. (FIG. 5). A compression member can buckle laterally forming half of a sine wave between points of lateral support. When this happens, the member also rotates about the support as it buckles. The distance between points of inflection on the sine wave is called the effective length. Shortening the effective length increases the force required to buckle a compression member. Adding a lateral brace shortens the effective length, increasing capacity. (FIG. 6). Preventing end rotation also shortens the effective length and increases the capacity of compression members. (FIG. 7).

A connection between a secondary framing member and a primary framing member that provides both lateral and rotational restraint of the primary framing member will shorten the effective length of the primary framing member, increasing its ability to support compressive forces and allowing the use of smaller, less expensive primary framing members.

Field installed structural hinges are not used to connect dimension lumber commonly used as secondary framing members in light-wood construction because no cost-effective means of making this connection is available. The methods currently used to connect secondary framing members to primary framing members do not provide rotational restraint of the primary framing members. There is a need for a cost-effective means of utilizing structural hinges and rotational restraints so that smaller framing members can be used, saving both resources and money.

Currently, it is common for secondary framing members to be spliced at the primary framing members. The secondary framing members are either set between or run over the primary framing members. Ledger boards or light-gauge steel hangers support the simple-span secondary framing members when they are set between the primary framing members. Usually simple lap splices are used when the secondary framing members run above the primary framing members. Sometimes butt splices are used. Often secondary framing members located above the primary framing members are simple spans. Sometimes the secondary framing members run continuously over two, three, or even four primary framing member spans. Long spikes or screws installed in holes drilled through the secondary framing members are frequently used to attach secondary framing members to primary framing members. A variety of light gage steel clips and wood blocking is also used. None of these solutions are optimal.

Solid sawn lumber up to 20' long is readily available. Longer lengths are not. This means solid sawn lumber can only be used in the more efficient multi-span configuration when spans are 10' or less. Simple-spans are inefficient because they do not include the moment and deflection reductions inherent with the development of a negative moment zone; lap splices require redundant material and result in offsets in the fastener lines; drilling holes for connection hardware can weaken the member at a high-stress location; and, because lumber is limited to 20' maximum lengths, multi-span solutions require close spacing of the primary members, increasing both material and installation labor costs when compared to systems that enable fewer, larger primary members.

Engineers are aware of the advantages of continuous members and strategically located structural hinges. It is common practice when end splicing "I" shaped steel beams to use zero moment details such as the standard "End Plate Shear" or "Framed Beam" details. These details result in structural hinges because they support shear but do not carry moment (e.g., American Institute of Steel Construction).

Commercially-available, heavy, welded steel connection brackets are used to produce structural hinges in large wood beams (e.g., Simpson StrongTie HCA Hinge Connectors). Morton Buildings Inc. uses a structural hinge formed from two light-gauge steel plates that are pressed into the end of 2x4 secondary framing members at the factory. Assembly is completed with field-installed screws. None of these solutions provide a cost effective means of forming at the construction site the dozens of structural hinges required to connect secondary framing members in a typical wood frame structure.

Under the current state of the art, forming an end-to-end splice that results in a long continuous member requires precision shaping of the mating ends, specialized clamping equipment, exacting application of glue, and proper curing conditions (e.g., glulam beam fabricators). Continuous end-to-end splices must be made in a controlled environment. It is nearly impossible at a construction site. Further, transporting and handling long lumber is difficult.

BRIEF SUMMARY OF THE INVENTION

Two connectors are used to improve a system of wood framing commonly used to form roof and floor assemblies. The first, the end-to-end connector, allows end-to-end connection of secondary members. The joint thus formed acts as a structural hinge which, when properly located, significantly reduces maximum moment and deflection compared to current simple-span conditions. The second, the top mount connector, provides a secure connection between continuous secondary members and the top of primary members. This connector provides support for the secondary members and, by resisting rotation of the primary members by attaching them to the roof or floor sheathing supported by the secondary members, provides superior bracing of the primary members. Used together, the connectors provide a new way of supporting members in a structure that both reduces maximum moment and deflection and resists rotation of the primary members.

BRIEF DESCRIPTION OF THE DRAWINGS

FIG. 8 shows a side view of the End-to-End Connector (5), with inspection hole (6), fastener hole (7), integral justifying wedge (9), internal locator tab (10), and exposed alignment guide area (8).

FIG. 9 shows an isometric view of the End-to-End Connector (5), with inspection hole (6), fastener hole (7), integral justifying wedge (9), internal locator tab (10), and exposed alignment guide area (8).

FIG. 13 shows an exploded view of the construction sequence using the End-to-End Connector (5) to connect a supported secondary member (11).

FIG. 14 shows an exploded view of the construction sequence using the End-to-End Connector (5) to connect a supported secondary member (11) to a cantilevered secondary member (12) cantilevered over the primary member (13), when the supported and cantilevered secondary members are not similarly sized.

FIG. 15 shows the End-to-End Connector (5) connecting a supported secondary member (11) to a cantilevered secondary member (12) cantilevered over the primary member (13), supporting sheathing (1), when the supported and cantilevered secondary members are not similarly sized.

FIG. 16 shows a plastic embodiment of the Top Mount Connector (14), with lower groove (16), upper groove (17), gussets (18), and torsion-resistant plate (19).

FIG. 17 shows a folded sheet steel embodiment of the Top Mount Connector (15), with lower groove (16), upper groove (17), gussets (18), and torsion-resistant plate (19).

REFERENCE NUMERALS

Figure 1:
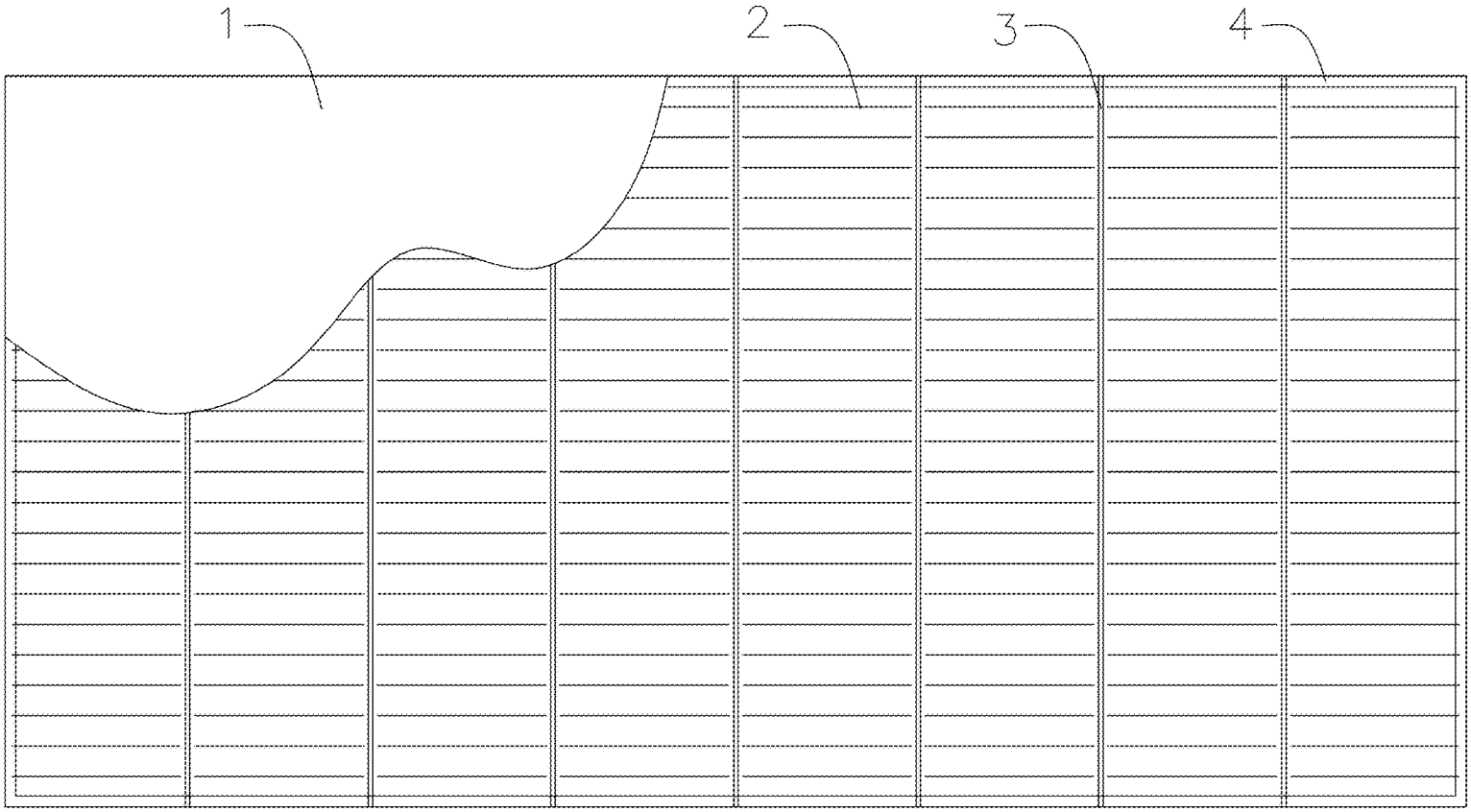
FIG. 1 shows a schematic of a typical roof plan using primary members (3) and secondary members (2) to support sheathing (1) in a supporting structure (4).
Figure 2:
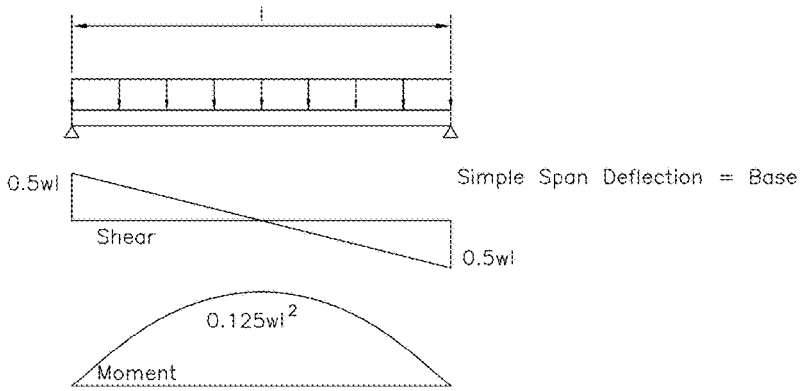
FIG. 2 shows the shear and moment distribution in a uniformly-loaded simple span configuration.
Figure 3:
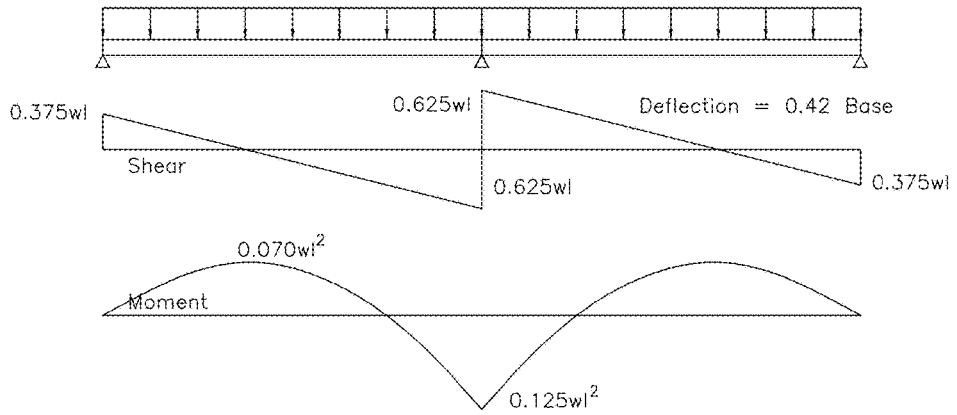
FIG. 3 shows the shear and moment distribution in a uniformly-loaded double-span configuration.
Figure 4:
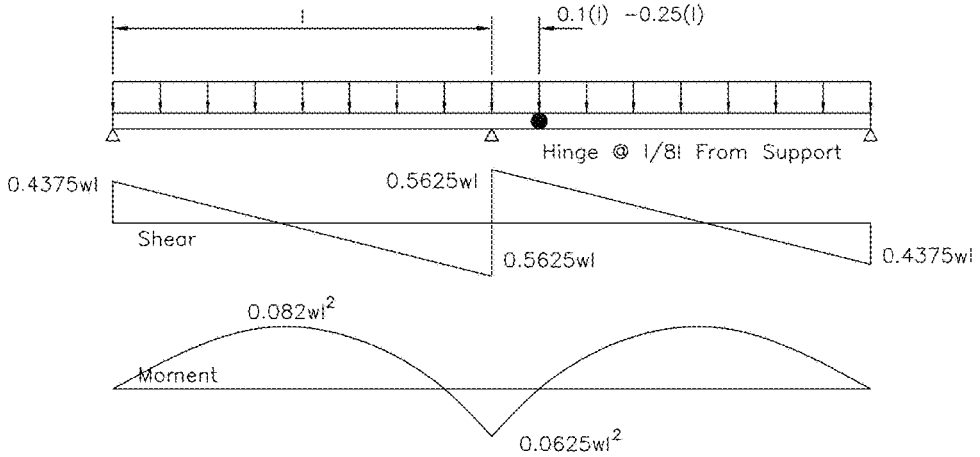
FIG. 4 shows the shear and moment distribution in a uniformly-loaded double-span configuration with a structural hinge placed one-eighth of the length of the span away from the interior support.
Figure 5:
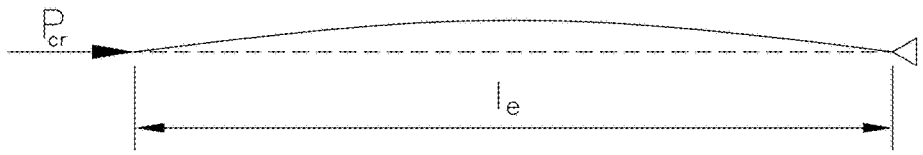
FIG. 5 shows the effective length of a compression member.
Figure 6:
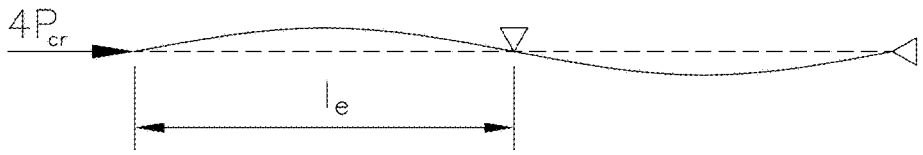
FIG. 6 shows the effective length of a compression member with a lateral brace.
Figure 7:
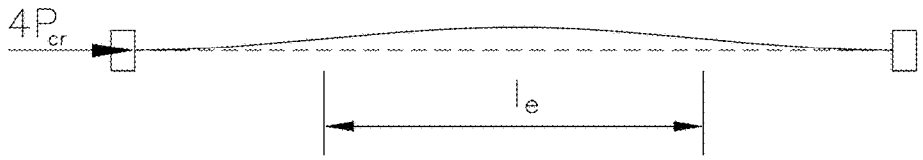
FIG. 7 shows the effective length of a compression member when end rotation is prevented.

1. Sheathing 2. Secondary member 3. Primary member 4. Supporting structure 5. Isometric view of end-to-end connector 6. Inspection hole 7. Fastener hole 8. Exposed area serving as an alignment guide 9. Integral justifying wedge 10. Internal locator tab 11. Supported secondary member 12. Cantilevered secondary member 13. Primary member 14. Plastic embodiment of the Top Mount Connector. 15. Folded sheet steel embodiment of the Top Mount Connector 16. Lower groove 17. Upper groove 18. Gussets 19. Torsion-resistant plate

DETAILED DESCRIPTION OF THE INVENTION

Two families of connectors are used to improve a system of wood framing commonly used to form roof and floor assemblies. The first, the end-to-end connector, allows end-to-end connection of secondary members. The joint thus formed acts as a structural hinge which, when properly located, significantly reduces maximum moment and deflection compared to current simple-span conditions. Further, the connector proposed is low-cost, easy to install in the field, and structurally robust in that it readily transfers forces applied in directions other than the designed-for-gravity load. The second, the top mount connector, securely connects continuous secondary members to the top of primary members. This connector provides support for the secondary members and, by resisting rotation of the primary members by attaching them to the roof or floor sheathing supported by the secondary members, provides superior bracing of the primary members. Further, it quickly locates the primary member with respect to the previous frame, accommodates thermal expansion of the sheathing, and does not reduce the structural capacity of the connected members. Together, the connectors provide a new way of supporting members in a structure that both reduces maximum moment and deflection and resists rotation of the primary members.

Figure 10:
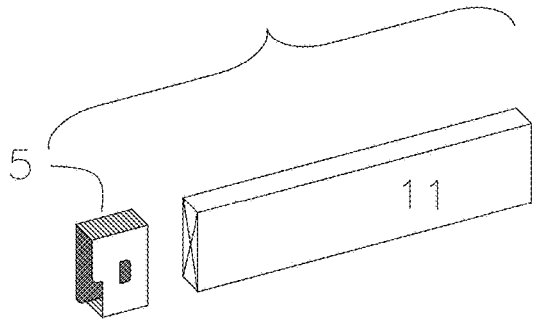
FIG. 10 shows an exploded view of the construction sequence using the End-to-End Connector (5) to connect a supported secondary member (11).
Figure 11:
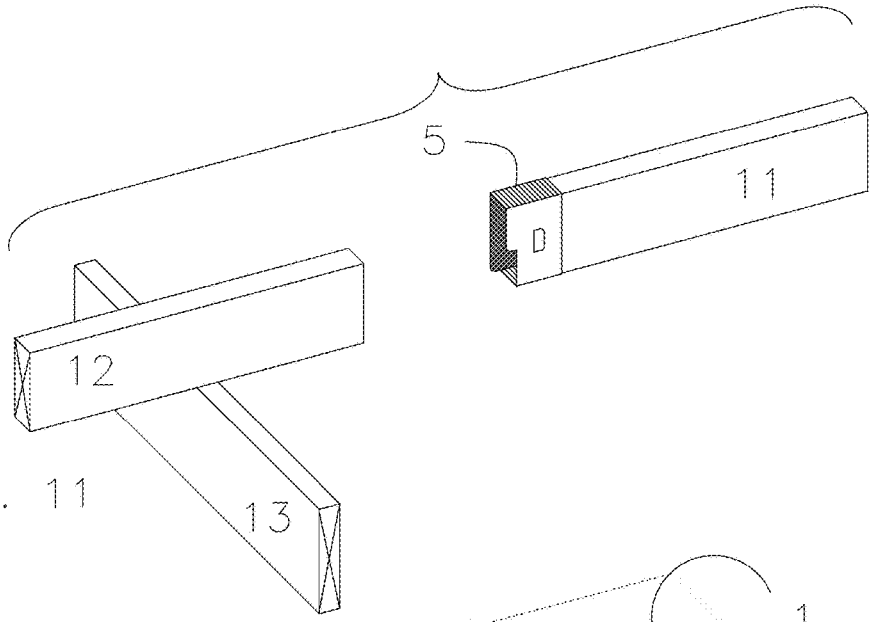
FIG. 11 shows an exploded view of the construction sequence using the End-to-End Connector (5) to connect a supported secondary member (11) to a cantilevered secondary member (12) cantilevered over the primary member (13), when the supported and cantilevered secondary members are similarly sized.
Figure 12:
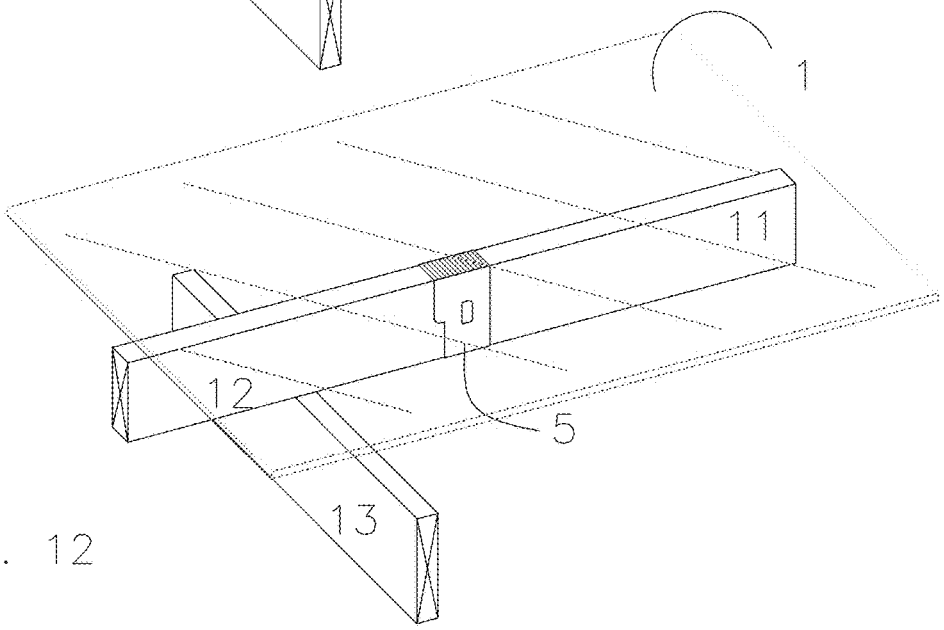
FIG. 12 shows the End-to-End Connector (5) connecting a supported secondary member (11) to a cantilevered secondary member (12) cantilevered over the primary member (13), supporting sheathing (1), when the supported and cantilevered secondary members are similarly sized.

The End-to-End Connector (EEC) (FIGS. 8-9) connects two secondary members end-to-end. (FIGS. 10-12). The first secondary member, the cantilevered secondary member (12), is cantilevered over the primary member (13) a predetermined distance. The second secondary member, the supported secondary member (11), is connected to the cantilevered secondary member end-to-end via the EEC (5). The connection is typically located 1/10 to 1/4 of the span away from the primary member (13), although other distances could be used. This causes a moment reversal in the cantilevered secondary member (12) under uniform load. FIGS. 10-12 show drawings of the construction sequence using the EEC (5) to connect a supported secondary member (11) to a cantilevered secondary member (12) cantilevered over the primary member (13).

The EEC acts as a structural hinge. It is meant to be used in the field to make end-to-end connections of secondary members. It has very little resistance to bending forces but provides excellent shear transfer in both the strong axis "Z" and weak axis "Y" directions. It resists positive and negative shear in the Z and Y directions and torsion about the X axis primarily through bearing. This allows the efficient transfer of large forces. The EEC also provides significant axial tension capacity in the "X" direction. Tension resistance is provided by the fasteners. The ability of the EEC to resist significant forces in several directions means the connected members are firmly linked together, producing a sturdy, structurally robust connection.

The secondary members could be standard-size, square-cut or irregularly sized and shaped. The EEC creates a structural hinge that transfers shear, but not moment, across the end-to-end connection. It is a tube with inside dimensions similar to the members being joined. In one embodiment, the EEC is formed from 24 to 16 gauge galvanized sheet steel, although it could be formed from any suitable material that would provide strength and rigidity and be thin enough to not interfere with sheathing, like plastic or wood. The tube is approximately 4" long, although it could be longer or shorter depending on the structure. For example, a tube used to join 2"×4" members could be approximately 4" long. The members being joined are inserted into opposite ends of the tube. The members might meet at the center of the length of the tube, or at a predetermined point off-center.

If the members joined are of differing depths, the member with the larger depth can be accommodated by opening the bottom of the tube on the side that supports that member. (FIGS. 13-15). This can be done by removing the material, using the material to extend the sides of the connector below the bearing point of the member, or bending the material up to form a tab between the two joined secondary members.

An integral wedge (9) is formed into the bottom of the EEC. The wedge forces the supported secondary member firmly against the top of the connector as the member is inserted. Thus the sheathed surface of the assembly is planar, even if the lumber varies slightly in size. This results in a smooth plane on the upper surface. The unique 'top justification' eliminates bulges in the sheathing due to variation in lumber size. Wedges might also be incorporated in the sides of the connector if lateral justification of lumber is needed. Further, the wedge firmly grips the member, holding the connector in place such that the worker has both hands free to operate tools, etc.

Inspection holes and internal locator tabs make it quick and easy to properly position the EEC. Inspection holes (6) are located that both ends of the connected secondary members can be observed to ensure they are fully seated. Locator tabs (10) are provided to stop the members at the mid-point or a different pre-determined point along the length of the tube. This prevents inserting the first secondary member too far into the connector. Bending the material removed to form the inspection hole toward the interior of the connector is one method of forming both locator tab and inspection hole. Fastener holes (7) could be produced as the EEC is manufactured. The EEC could be fastened to the members with nails, screws, bolts, staples, or other mechanical fasteners.

The EEC has an area removed from one end. The exposed surface on the opposing side (8) acts as an alignment guide. This allows the connector and associated supported secondary member (11) to be quickly aligned with the cantilevered secondary member (12). This alignment aid results in faster, more efficient construction.

The EEC can be mass-produced from steel coil using progressive dies. This is the fabrication method used to form the inexpensive clips and hangers frequently used to reinforce modern, light-wood frame construction. The joint resulting from closing the tube can be lapped and riveted or welded. Or, alternatively, the tube could be closed with interlocking components. Or the field installed fasteners used to attach the clip to the wood secondary framing members could also form the connection. The EEC could also be formed using molds or other means of mass production.

The EEC is typically attached to the supported secondary member while on the ground. The supported secondary member and associated EEC is then lifted into position, aligned with the cantilevered secondary member, tapped home, and fastened. (FIGS. 10-15). Pre-punched holes make it easy to install the proper number of screws or nails. The EEC surrounds the end of each member. Once driven into position, the members are held firmly in position even before fasteners are installed. This frees both hands for fastener installation.

The bottom of the EEC could be opened to allow a cantilevered secondary member that has a larger depth than the supported secondary member. This feature allows secondary members of mixed sizes. This makes further optimization of the secondary framing possible.

The direct, in-line end-to-end splice formed by the EEC eliminates lapping the secondary members. This saves material and results in straight fastener lines, improves the appearance of exposed fastener roofing, and simplifies installation in all cases.

The EEC enables optimal location of structural hinges in each run of framing. Properly located structural hinges can significantly reduce both deflection and required strength. This can result in the ability to use smaller, less expensive framing members.

Figure 18:
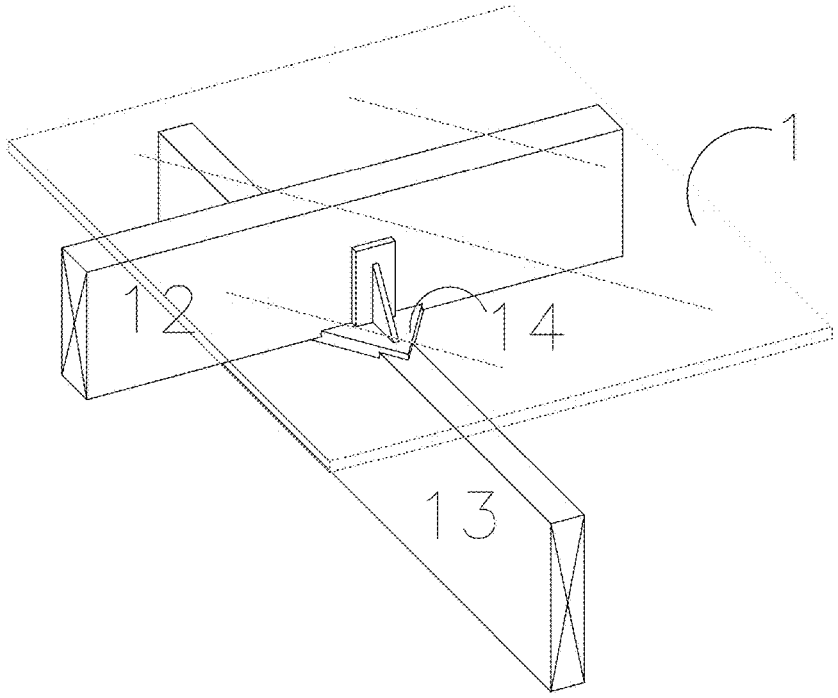
FIG. 18 shows a plastic embodiment of the Top Mount Connector (14) installed to connect primary members (13) to secondary members (12), supporting sheathing (1).
Figure 19:
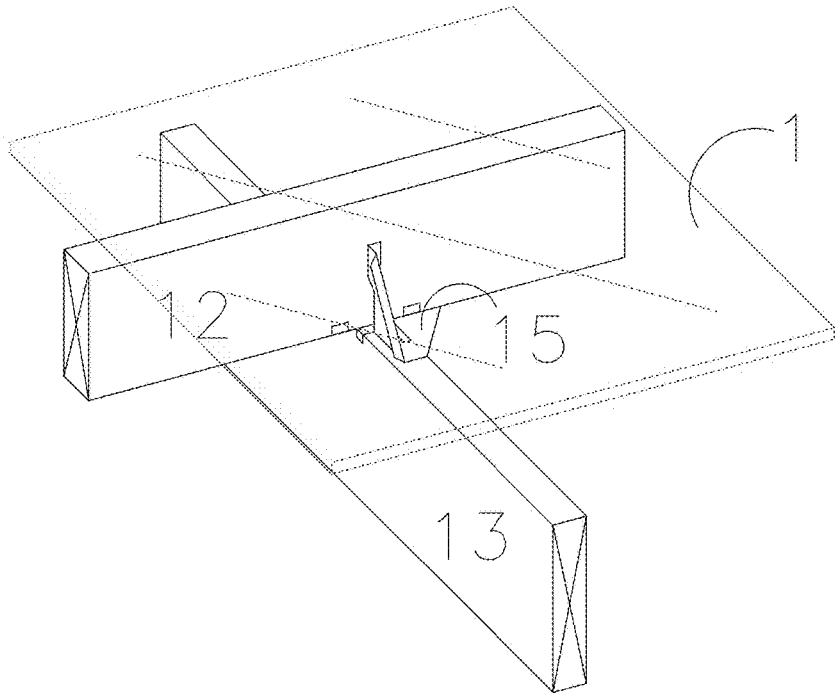
FIG. 19 shows a folded sheet steel embodiment of the Top Mount Connector (15) installed to connect primary members (13) to secondary members (12), supporting sheathing (1).

The Top Mount Connector (TMC) (FIGS. 16-17) is used to connect a secondary member to the top of a primary member (FIGS. 18-19). The secondary member is cantilevered over the primary member. The cantilevered secondary member might cross the primary member at a right angle or at acute and obtuse angles. FIG. 18 shows drawings of a plastic embodiment of the Top Mount Connector (14) installed to connect primary members to secondary members. FIG. 19 shows drawings of a folded sheet steel embodiment of the Top Mount Connector (15) installed to connect primary members to secondary members.

The TMC comprises a plate (19) that is sandwiched between the secondary and primary members. Grooves, which align with the primary and secondary members, are formed into the top (17) and bottom (16) sides of the plate. The grooves are sized to snugly engage both of the primary and secondary members. The TMC requires no drilling or other machining of either member. This reduces costs and eliminates the reduction in bending capacity associated with reductive machining operations.

Fasteners are driven through the plate into both of the members to lock the two members together, preventing them from separating or rotating with respect to each other about the Z-axis. Two gussets (18) are formed into the top surface of the TMC.

The gussets are positioned on either side of the secondary member and are fastened to it. The fasteners that connect the TMC to the primary framing are conveniently located on top of the assembly, allowing fast and safe installation. These fasteners are driven through holes manufactured in the TMC. The TMC could be fastened to the members with nails, screws, bolts, staples, or other mechanical fasteners.

The TMC firmly resists rotation of the upper member about the X-axis. Additionally the TMC resists relative translation in the X, Y, and Z directions. Finally, because the secondary member is firmly attached to the roof or floor, the entire assembly is prevented from rotating about the "Z" axis. It is this rotational restraint that reduces the effective length of the primary member thereby increasing its capacity to support load. While the TMC prevents excessive rotation of the supported secondary member about the X-axis it allows the small movement needed to accommodate thermal expansion/contraction of the sheathing material.

The TMC resists rotation of the primary member by locking it firmly to the cantilevered secondary member and the associated roof or floor. Each member fits into a groove formed into the upper and lower surfaces of the torsion-resistant plate. This rotational restraint further reduces the effective buckling length of the primary member. Depending on primary member geometry, this can significantly increase the capacity of the primary member and allow the use of smaller, less expensive primary members.

The TMC can be formed from several materials. FIGS. 16-17 show two possible embodiments. The first is an injection molded plastic part (14). The second is a part formed from 16 to 24 gauge steel coil using progressive dies (15).

Figure 20:
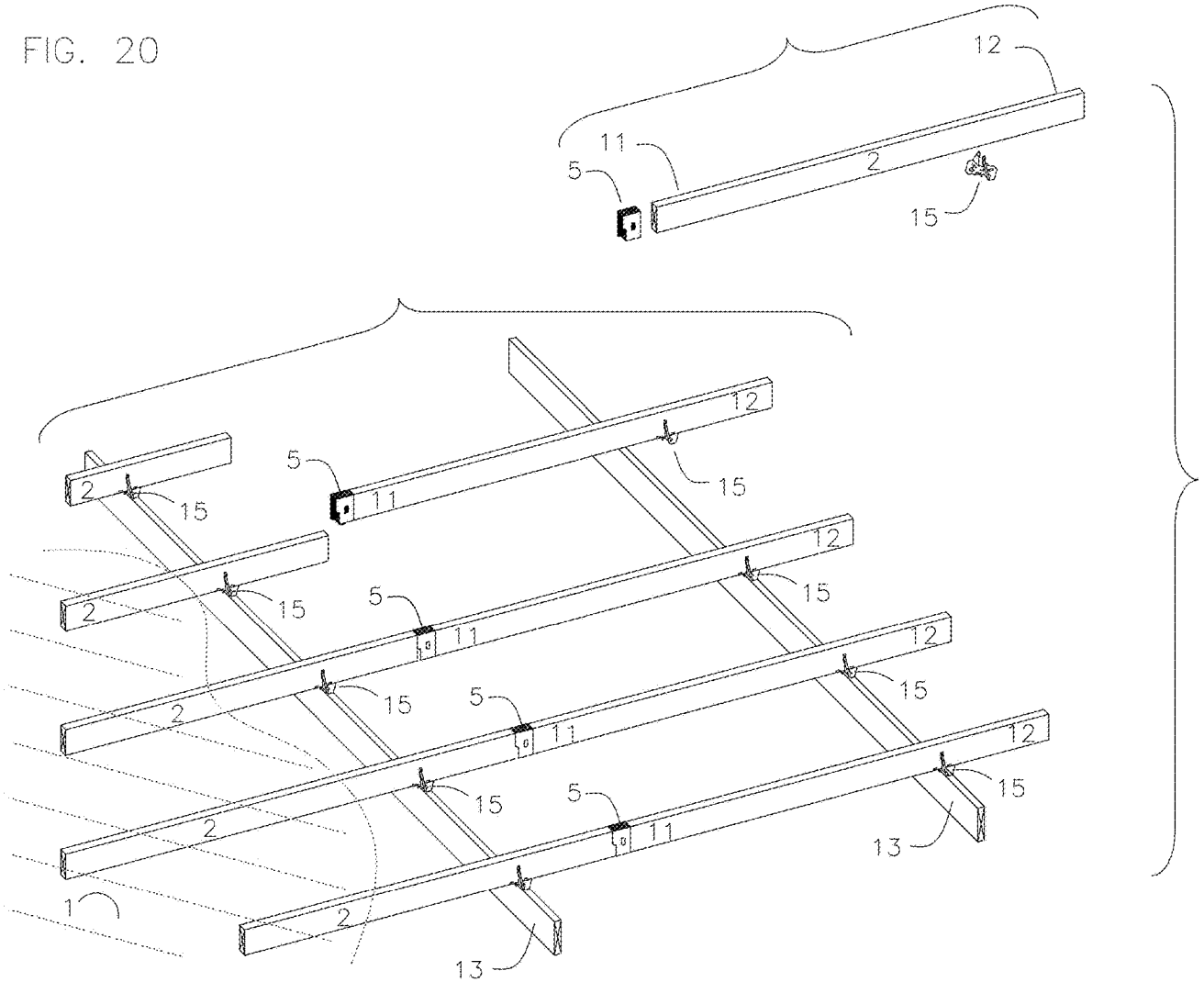
FIG. 20 shows an exploded view of the construction sequence using the End-to-End Connector (5) to connect supported secondary members (11) to cantilevered secondary members (2 & 12) cantilevered over the primary members (13) and the Top Mount Connector (15) to connect primary members (13) to secondary members (2, 11, & 12).

The EEC and the TMC can be used separately or in conjunction with one another. They can be used once in a structure or repetitively in a structure. FIG. 20 shows a drawing of using the EEC (5) to connect supported secondary members (11) to cantilevered secondary members (2 & 12) cantilevered over the primary members (13) and the TMC (15) to connect primary members (13) to secondary members (2, 11, & 12) repeatedly in a sequence.

One of the many benefits of using the improved wood framing system is that much of the installation is done while safely on the ground by construction workers. The workers first consult the framing plan to determine the quantity, lengths, and bearing location of secondary members used to frame each building bay. The workers should build the walls and support structure per normal procedures.

The workers then cut the secondary members to exact length with a portable chop saw. The cutting station should include movable marking guides that enable the rapid and accurate marking of the location of the TMC and EEC for each secondary member.

The workers next install the TMC and EEC on the secondary members at the locations indicated. This work should be done while on the ground.

The workers add the secondary members to each primary member as it is set. This provides immediate bracing of the primary member and, when combined with a proper whole-building bracing strategy, results in a stable, safe-build sequence.

This operation is fast and easy because no measuring is required and the connectors do not need to be handled during the framing operation because they are pre-installed on the secondary framing. The EEC lands on the secondary member of the previous bay by aligning the EEC and fully seating it.

The secondary member with TMC installed has become a gauge used to properly space the primary frame. The workers simply align the groove and complete the installation by installing the fasteners, which are conveniently located on the top of the primary framing member.

The claimed system offers efficiency benefits. For example, a 48' ×96' post frame building has primary frames that are 12' O.C. The roof has 7 psf of dead load and must support 30 psf of snow. The building has a steel roof with a deflection limit of L/120. Secondary framing is 30" O.C. resulting in eleven rows on each side of the roof for 22 total rows×8 bays for a total of (176) 12' long secondary members. A 2"×8" mid-grade MSR secondary is required if simple spans are used. When a 2' cantilever and structural hinge is used, 2"×6" secondary members of a similar grade are sufficient. The use of structural hinges reduces the amount of wood that must be purchased for roof secondary members by 25% in this case. This equates to more than $450.00 in savings at current lumber prices.

2"×18"×12'×176 members/12 sq.in.per board ft=2816 board feet

2"×6"×12'×176 members/12 sq.in.per board ft=2112 board feet

2816−2112=704 board feet saved 704 board feet×$0.65 /board foot=$457.60 savings

The invention claimed is:

1. A method for connecting a primary member, a cantilevered secondary member, and a sheathing, comprising:

cantilevering a cantilevered secondary member over a primary member wherein said cantilevered secondary member extends substantially perpendicular to said primary member;

placing a plate between said cantilevered secondary member and said primary member, said plate having a top surface and a bottom surface, said plate extending beyond each of a first side and a second side opposite said first side of each of said cantilevered secondary member and said primary membe in a plane defined by a bottom surface of said secondary member said plate having a first groove formed into said top surface of said plate that receives said cantilevered secondary member, a second groove formed into said bottom surface of said plate that receives said primary member, and a first gusset and a second gusset each extending from said top surface of said plate, said first gussset abutting said first side of said cantilevered secondary member, and said second gusset abutting said second side of said cantilevered secondary member, said plate rests on a top surface of said primary member and below said cantilevered secondary member and said cantilevered secondary member rests between said gussets;

fastening said plate to said cantilevered secondary member;

fastening said plate to said primary member;

fastening said gussets to said cantilevered secondary member; and connnetin said cantilevered secondary member to a sheathing which connects said primary member to said sheathing which prevents both lateral and rotational movement of said primary member.

2. The method of claim 1 further comprising:

inserting an end of a supported secondary member into a first opening of a sheath having a bottom, a top, a first side and a second side, and a locater tab on an inside surface of said first side of said sheath;

inserting an end of said cantilevered secondary member into a second opening of said sheath, said sheath further comprising a wedge formed in an inside surface of said bottom of said sheath that forces said cantilevered secondary member and said supported secondary member against an inside surface of said top of said sheath, an inspection hole formed in said first side of said sheath that allows observation of said cantilevered secondary member and said supported secondary member, said locater tab being configured to stop said cantilevered secondary member and said supported secondary member from inserting beyond a predetermined point along a length of said sheath; and fastening said sheath to said cantilevered secondary member and said supported secondary member.

3. A system for connecting a primary member, a cantilevered secondary member, and a supported secondary member in a structure, comprising:

a cantilevered secondary member that is cantilevered substantially perpendicularly over a primary member;

a sheath having a bottom, a top, a first side and a second side, locater tab formed on an inside surface of said first side of said sheath, and a first opening and a second opening, wherein said first opening receives an end of a supported secondary member, said second opening receives an end of said cantilevered secondary member, a wedge formed in an inside surface of said bottom of said sheath that forces said cantilevered secondary member and said supported secondary member against an inside surface of said top of said sheath, an inspection hole formed in said first side of said sheath that allows observation of said. cantilievered secondary member and said supported secondary member, said locator tab being configured to stop said cantilevered secondary member and said supported secondary members from inserting beyond a predetermined point along a length of said sheath;

a plate having a top surface and a bottom surface, said plate extending beyond each of a first side and a second side opposite said first side of each of said secondary member and said primary member in a plane defined by a bottom surface of said secondary member, said plate rests between said primary member and said cantilevered secondary member, wherein two parallel gussets protrude upwards from said plate and said cantilevered secondary member rests between said gussets;

fasteners that, fasten said sheath to said cantilevered secondary member and said supported secondary member;

fasteners that fasten said plate to said primary member and said cantilevered secondary member; and fasteners that fasten said gussets to said cantilevered secondary member.

4. A connector connecting a secondary member to a top of a primary member, comprising:

a plate having a top surface and a bottom surface, said plate extending beyond each of a first side and a second side opposite said first side of each of said secondary member and said primary member in a plane defined by a bottom surface of said secondary member;

a groove formed into said top surface of said plate that receives said secondary member;

a groove formed into said bottom surface of said plate that receives said primary member;

a first gusset and a second gusset extending from said top surface of said plate, the first gusset abutting said first side of said secondary member, and the second gussett abutting said second side of said secondary member said second side of said secondary member being opposite said first side of said secondary member;

a first fastener connecting said plate to said secondary member;

a second fastener connecting said plate to said primary member; and a third fastener and a fourth fastener respectively connecting said first gusset and said second gusset to said secondary member.

5. A connector connecting two secondary members end-to-end, comprising:

a sheath having a bottom, a top, a first side and a second side opposite said first side, and a locator tab formed on an inside surface of said first side of said sheath, said sheath sized to receive said cantilevered secondary member and said supported secondary member;

a wedge formed in an inside surface of said bottom of said sheath that forces said cantilevered secondary member and said supported secondary member against an inside surface of said top of said sheath;

an inspection hole formed in said first side of said sheath that allows observation or said cantilevered secondary member and said supported secondary member;

said locater tab configured to stop said cantilevered secondary member and said supported secondary member from inserting beyond a predetermined point along a length of said sheath; and a first fastener and a second fastener respectively connecting said sheath to said secondary members.

* * * * *